US006483414B2

(12) United States Patent
Takeuchi et al.

(10) Patent No.: US 6,483,414 B2
(45) Date of Patent: Nov. 19, 2002

(54) METHOD OF MANUFACTURING MULTILAYER-TYPE CHIP INDUCTORS

(75) Inventors: Hiroyuki Takeuchi, Shiga-ken (JP); Masaharu Ikeda, Omihachiman (JP); Motoi Nishii, Omihachiman (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 27 days.

(21) Appl. No.: 09/808,135

(22) Filed: Mar. 15, 2001

(65) Prior Publication Data

US 2001/0020885 A1 Sep. 13, 2001

Related U.S. Application Data

(62) Division of application No. 09/028,748, filed on Feb. 24, 1998, now Pat. No. 6,223,422.

(30) Foreign Application Priority Data

Feb. 24, 1997 (JP) ..... 9-39153

(51) Int. Cl.[7] ..... H01F 5/00

(52) U.S. Cl. ..... 336/200; 336/232; 29/602.1

(58) Field of Search ..... 336/200, 223, 336/232; 29/602.1, 605, 606, 607, 608

(56) References Cited

U.S. PATENT DOCUMENTS 4,543,553 A * 9/1985 Mandai et al. ..... 336/83
5,302,932 A * 4/1994 Person et al. ..... 336/200
5,802,688 A 9/1998 Tanaka
6,189,200 B1 * 2/2001 Takeuchi et al. ..... 29/602.1

FOREIGN PATENT DOCUMENTS

JP 410241941 A * 9/1998

* cited by examiner

*Primary Examiner*—Anh Mai
(74) *Attorney, Agent, or Firm*—Burns, Doane, Swecker & Mathis, LLP

(57) ABSTRACT

A method is provided for manufacturing a multilayer-type chip inductor having a small DC resistance without decreasing the inductance or the impedance. The method of manufacturing a multilayer-type chip inductor includes the steps of: preparing a ceramic green sheet; forming an electrode film on one surface of the green sheet; multilayering a plurality of the green sheets in such a way that the surfaces on which electrode films are formed face each other for pairs of the green sheets; contact-bonding the green sheets; and sintering the green sheets.

16 Claims, 5 Drawing Sheets

METHOD OF MANUFACTURING MULTILAYER-TYPE CHIP INDUCTORS

This application is a division of Ser. No. 09/028,748, filed Jan. 24, 1998, U.S. Pat. No. 6,223,422.

This application claims priority under 35 U.S.C. §119 to Japanese Patent Application No. 9-39153 filed in Japan on Feb. 24, 1997, the entire content of which is hereby incorporated by reference.

BACKGROUND OF THE INVENTION

1. Field of the Invention

The present invention relates to a method of manufacturing a multilayer-type chip inductor, and in particular, a multilayer-type chip inductor having a small DC resistance.

2. Description of the Related Art

A method of reducing the DC resistance of a multilayer-type chip inductor involves increasing the cross-sectional area of an internal conductor. In order to increase the cross-sectional area of an internal conductor, the width and the thickness of the internal conductor may be increased. If the width of the internal conductor is increased, however, the inductance decreases. Increasing the cross-sectional area of the internal conductor also may cause various manufacturing problems. Therefore, it is difficult in practice to increase the cross-sectional area of the internal conductor. For this reason, a coil comprising parallel internal conductors has been conceived as a method for decreasing the DC resistance of an inductor.

First, a multilayer-type chip inductor of a first conventional example in which coils are connected in parallel will be described with reference to FIGS. 4 and 5. FIG. 5 is a cross-sectional view of the device shown in FIG. 4.

With reference to both FIGS. 4 and 5, a multilayer-type chip inductor 1 is formed in such a way that green sheets 2*a* to 2*e* having electrode films 3*a* to 3*e* formed thereon, respectively, are multilayered in two upper and lower stages and sintered together. Further, external electrodes (not shown) are formed on both ends of this sintered body.

The first green sheets 2*a* to 2*e* are formed into sheets from an insulating ceramic slurry, such as ferrite or a dielectric. The electrode films 3*a* to 3*e*, which become internal conductors, are formed on one surface of the sheets by printing or like technique. Furthermore, in the first green sheets 2*b* to 2*e*, via holes 4*b* to 4*e* are provided at one end of each of the electrode films 3*b* to 3*e*. The upper and lower stages of first green sheets 2*a* to 2*e* are multilayered in sequence, causing the electrode films 3*a* to 3*e* to conduct in order to form two inductors 5. In parts of the electrode films 3*a* and 3*e*, one end of each film is extended to the end of each of the green sheets 2*a* and 2*e* so that it connects to and provides conduction with the external electrode (not shown), forming extension electrodes 6*a* and 6*e*, respectively.

The multilayer-type chip inductor 1 is obtained in the following way. As shown in FIG. 4, a predetermined number of dummy green sheets 2*f* on which no electrode film is formed are multilayered in sequence to form a bottom portion of the device. Next, the first green sheets 2*a* to 2*e* containing the electrode films 3*a* to 3*e* on their respective top faces are multilayered on top of the dummy green sheets 2*f*. Further, in the same manner, another series of green sheets 2*a* to 2*e* are multilayered, and a predetermined number of dummy green sheets 2*f* are applied. Then, the body is contact-bonded and sintered. Then, external electrodes are formed at both ends (the right side and the left side in FIG. 4) of this sintered body.

Since the first green sheets 2*a* to 2*e* shown in FIG. 4 are formed with the electrode films 3*a* to 3*e* of a ¾ turn, respectively, two inductors 5 of 3.5 turns are formed inside the sintered body.

The external electrode on the right side is made to conduct with the extension electrodes 6*a* and 6*a* of the inductors 5 and 5, and the external electrode on the left side is made to conduct with the extension electrodes 6*e* and 6*e* of the inductors 5 and 5. Therefore, as shown in FIG. 5, the multilayer-type chip inductor 1 is such that the two upper and lower inductors 5 and 5 are connected in parallel.

Next, a multilayer-type chip inductor of a second conventional example comprising a coil of parallel internal conductors will be described with reference to FIGS. 6 and 7. Components in FIGS. 6 and 7 which are the same as those of the above-described first conventional example are given the same reference numerals and a detailed description thereof is omitted.

A multilayer-type chip inductor 11 is formed in such a way that first green sheets 2*a* to 2*e* have electrode films 3*a* to 3*e* formed thereon, respectively. First green sheets 12*a* to 12*e* are similar to the first green sheets 2*a* to 2*e*. The green sheets 2*a* to 2*e* are alternately arranged (e.g., interleaved) in a multilayered fashion with the green sheets 12*a* to 12*e*. These multiple layers are then sintered, and then external electrodes (not shown) are formed at both ends of this sintered body.

The first green sheets 12*a* to 12*e* are formed into sheets from an insulating ceramic slurry in the same manner as the first green sheets 2*a* to 2*e*, and electrode films 13*a* to 13*e* are formed on one surface thereof. Further, in the first green sheets 12*b* to 12*e*, via holes 14*b* to 14*e* are formed at the ends of the electrode films 13*b* to 13*e*, respectively. In the first green sheets 12*a* to 12*d*, via holes 17*a* to 17*d* are provided at the other ends of the electrode films 13*a* to 13*d*, respectively.

The multilayer-type chip inductor 11 is obtained in the following way. As shown in FIG. 6, a predetermined number of dummy green sheets 2*f* are multilayered in sequence to from a bottom portion. Next, the first green sheets 2*a*, 12*a*, 2*b*, 12*b*, 2*c*, 12*c*, 2*d*, 12*d*, 2*e*, and 12*e* are multilayered on top of the bottom portion, with each surface having an electrode formed on its top side. Further, a predetermined number of dummy green sheets 2*f* are applied on top of the body, and then the body is contact-bonded and sintered. Then, external electrodes are formed at both ends (the right side and the left side in FIG. 6) of this sintered body.

Therefore, in the multilayer-type chip inductor 11, an inductor 15 of 3.5 turns which is made to branch into two lines via the respective via holes is formed within the multilayered body. The external electrode on the right side is made to conduct with the extension electrodes 6*a* and 16*a* of the inductor 15, and the external electrode on the left side is made to conduct with extension electrodes 6*e* and 16*e* of the inductor 15.

However, in the above-described conventional first and second examples, although the DC resistance of the inductor is reduced, the following problems are present. In the first conventional example, because the decrease in inductance is large, the number of windings of the coil must be increased to maintain the inductance at a desired value. In the second conventional example, although the decrease in inductance is small, the number of via holes corresponding to via holes 17*a* to 17*d* provided in the first green sheets 12*a* to 12*d* and the number of types of first green sheets increases, causing the manufacturing process to become more complex.

SUMMARY OF THE INVENTION

An object of the present invention is to solve at least the above-described problems. More specifically, an object of the present invention is to provide a method of manufacturing a multilayer-type chip inductor such that the DC resistance of the inductor is small without decreasing the inductance and the impedance.

To achieve the above-described object, according to the present invention, there is provided a method of manufacturing a multilayer-type chip inductor, comprising the steps of: preparing a ceramic green sheet; forming an electrode film on one surface of the green sheet; multilayering a plurality of the green sheets in such a way that the surfaces having electrode films formed thereon face each other for pairs of the green sheets; contact-bonding the green sheets; and sintering the green sheets.

More specifically, the present invention provides a method of manufacturing a multilayer-type chip inductor, comprising the steps of: preparing a ceramic green sheet; overlaying a first green sheet having a coil-like electrode film of less than one complete turn formed on one surface of the green sheet and a second green sheet having formed thereon a coil-like electrode film which is symmetrical with the first green sheet so that the electrode films face each other in order to be formed into a pair; multilayering a plurality of such pairs of the green sheets; and sintering the green sheets, wherein the respective coil-like electrode films are made to conduct by via holes provided at the ends of the coil-like electrode films, thereby forming an inductor.

Preferably, the ceramic is an insulating ceramic.

The method of manufacturing a multilayer-type chip inductor further includes a step of forming external electrodes which conduct to the ends of the inductor before or after being sintered.

As a result, as in the first and second conventional examples, it is possible to increase the cross-sectional area of the conductor and to reduce the DC resistance of the inductor. In the present invention, however, the design does not result in a decrease in the inductance and the impedance. Further, the manufacturing method of the present invention is less complex than the manufacturing method of the above-described second conventional example (e.g., because it reduces the number of via holes required).

BRIEF DESCRIPTION OF THE DRAWINGS

The above and further objects, aspects and novel features of the invention will become more apparent from the following detailed description when read in connection with the accompanying drawings, in which.

DESCRIPTION OF THE PREFERRED EMBODIMENT

Figure 1:
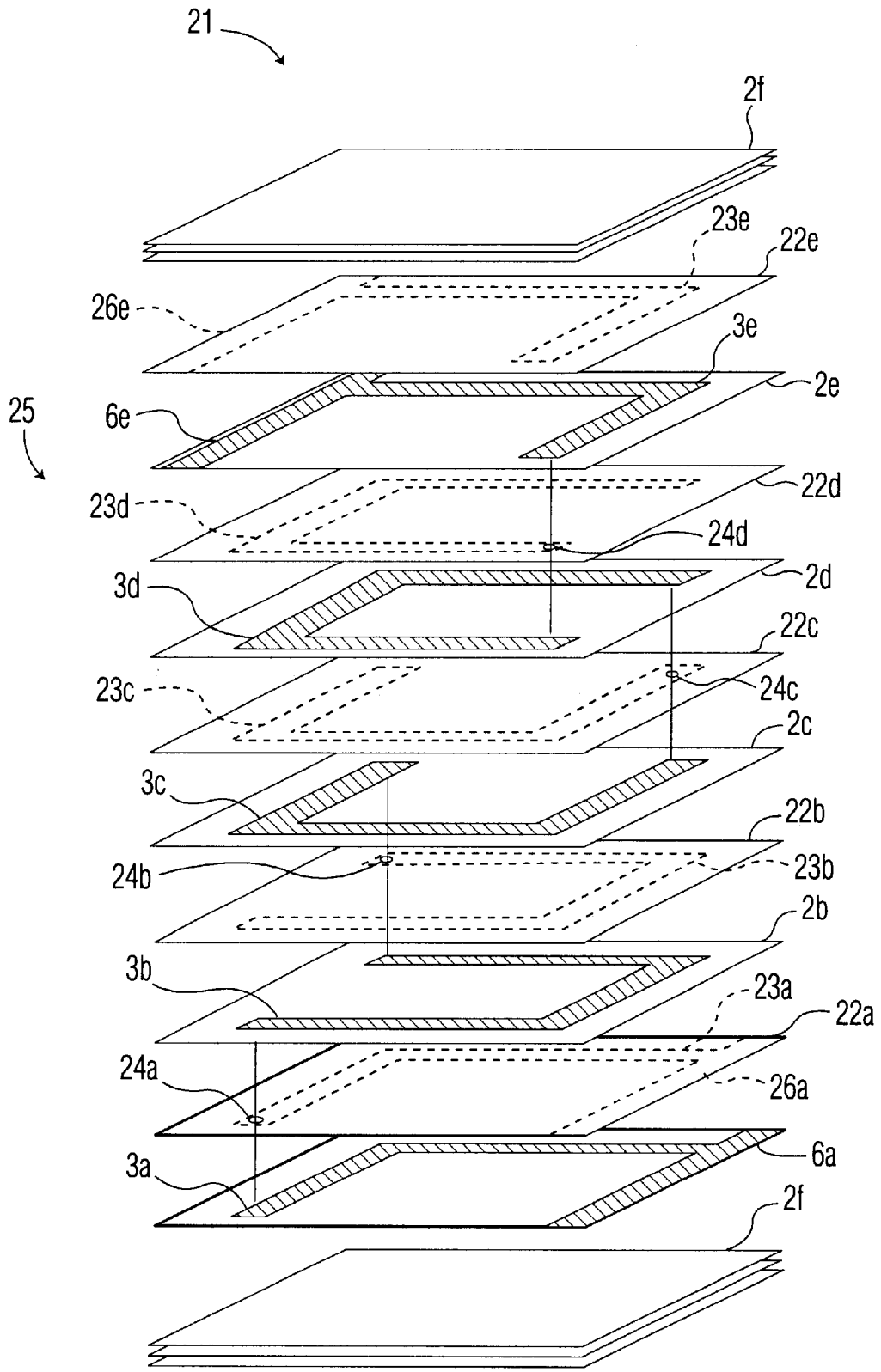
FIG. 1 is a perspective view illustrating a method of manufacturing a multilayer-type chip inductor before multilayering according to an exemplary embodiment of the present invention.

The preferred embodiment of the present invention will be described below in detail with reference to FIGS. 1 to 3. Components which are the same as those of the above-described conventional examples are given the same reference numerals. Detailed description of these common components is omitted.

A multilayer-type chip inductor 21 is formed in such a way that each one of first green sheets 2*a* to 2*e* has electrode films 3*a* to 3*e* formed respectively thereon, and each one of second green sheets 22*a* to 22*e* has electrode films 23*a* to 23*e* formed respectively thereon. These green sheets are alternately multilayered and sintered. External electrodes 28 and 29 are formed at both ends of this sintered body.

In the same manner as the first green sheets 2*a* to 2*e*, the second green sheets 22*a* to 22*e* are formed into sheets from an insulating ceramic slurry, such as ferrite or a dielectric or other suitable material. These sheets have electrode films 23*a* to 23*e*, which become internal conductors, respectively formed by printing or other suitable technique on one surface thereof. The respective electrode films 23*a* to 23*e* are formed symmetrically with respect to the electrode films 3*a* to 3*e* when they face the electrode films 3*a* to 3*e*. Further, in the second green sheets 22*a* to 22*d*, via holes 24*a* to 24*d* are formed at one end of each of the electrode films 23*a* to 23*e*. In parts of the electrode films 23*a* and 23*e*, one end of each film is extended to the ends of the green sheets 22*a* and 22*e* so as to conduct to the external electrodes, forming extension electrodes 26*a* and 26*e*.

The multilayer-type chip inductor 21 is obtained in the following way. As shown in FIG. 1, a predetermined number of dummy green sheets 2*f*, on the surface of which no electrode film is formed, are multilayered in sequence to form a bottom portion of the device. Next, the first green sheet 2*a*, the second green sheet 22*a*, the first green sheet 2*b*, the second green sheet 22*b*, . . . , the first green sheet 2*e*, and the second green sheet 22*e* are overlaid and multilayered in such a way that each pair of electrode films (the electrode film 3*a* and the electrode film 23*a*, . . . , the electrode film 3*e* and the electrode film 23*e*) face each other. Further, a predetermined number of dummy green sheets 2*f* are multilayered on top of the body, and then the body is contact-bonded and sintered. Then, external electrodes 28 and 29 are formed at both ends of this sintered body. Alternatively, the external electrodes can be applied before sintering.

Figure 2:
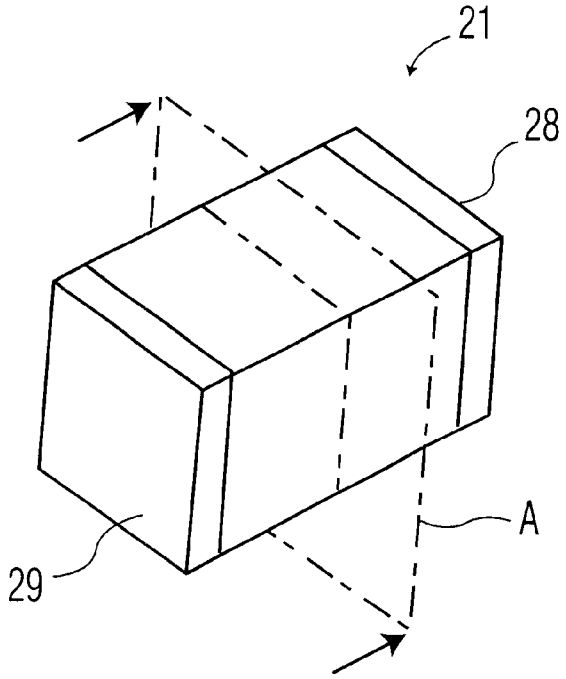
FIG. 2 is a perspective view of the multilayer-type chip inductor shown in FIG. 1.

Since the first green sheets 2*a* to 2*e* and the second green sheets 22*a* to 22*e* shown in FIG. 1 are formed with the electrode films 3*a* to 3*e* and the electrode films 23*a* to 23*e* of a ¾ turn, respectively, in the multilayer-type chip inductor 21, an inductor 25 of 3.5 turns is formed inside the multilayered body. One external electrode 28 is made to conduct with the extension electrodes 6*a* and 6*a* of the inductor 25, and the other external electrode 29 is made to conduct to the extension electrodes 6*e* and 6*e* of the inductor 25.

Figure 3:
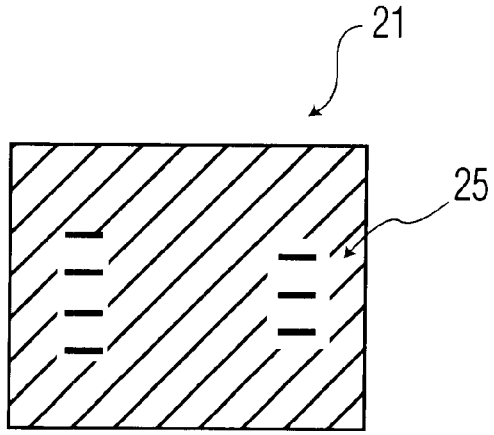
FIG. 3 is a longitudinal sectional view taken along the plane A of the multilayer-type chip inductor shown in FIG. 2.
Figure 4:
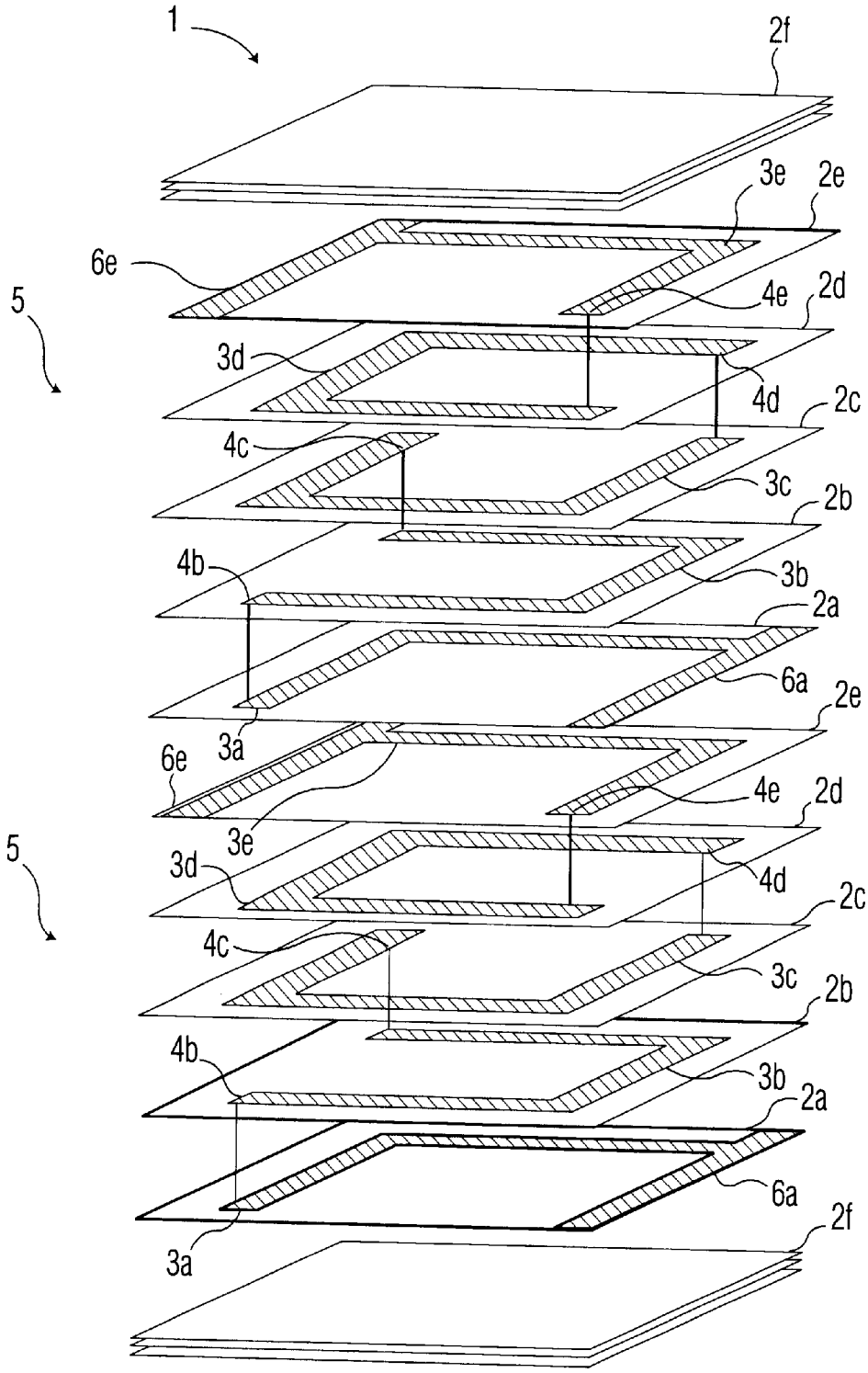
FIG. 4 (PRIOR ART)
FIG. 4 is a perspective view of a multilayer-type chip inductor of a first conventional example before multilayering.
Figure 5:
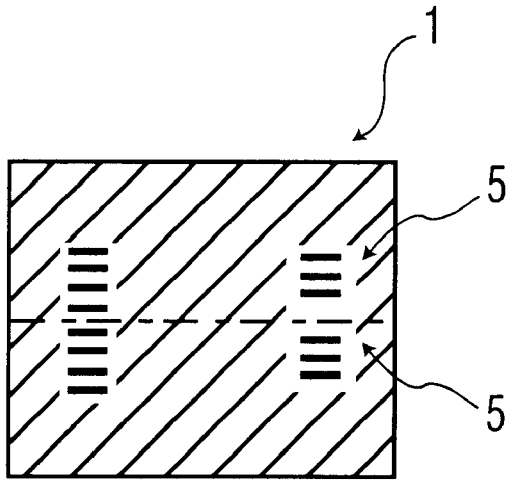
FIG. 5 (PRIOR ART)
FIG. 5 is a longitudinal sectional view corresponding to FIG. 3 of the multilayer-type chip inductor of the first conventional example.
Figure 7:
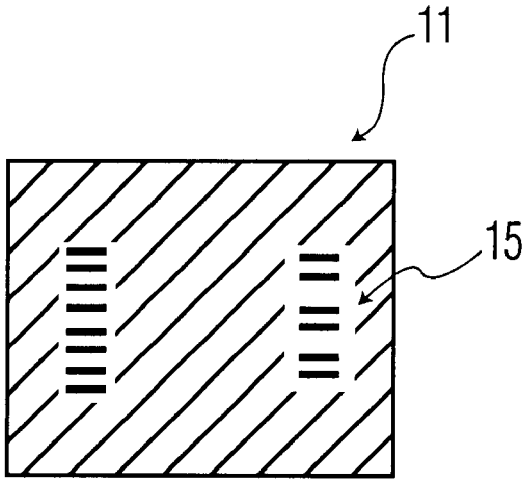
FIG. 7 (PRIOR ART)
FIG. 7 is a longitudinal sectional view corresponding to FIG. 3 of the multilayer-type chip inductor of the second conventional example.
Figure 6:
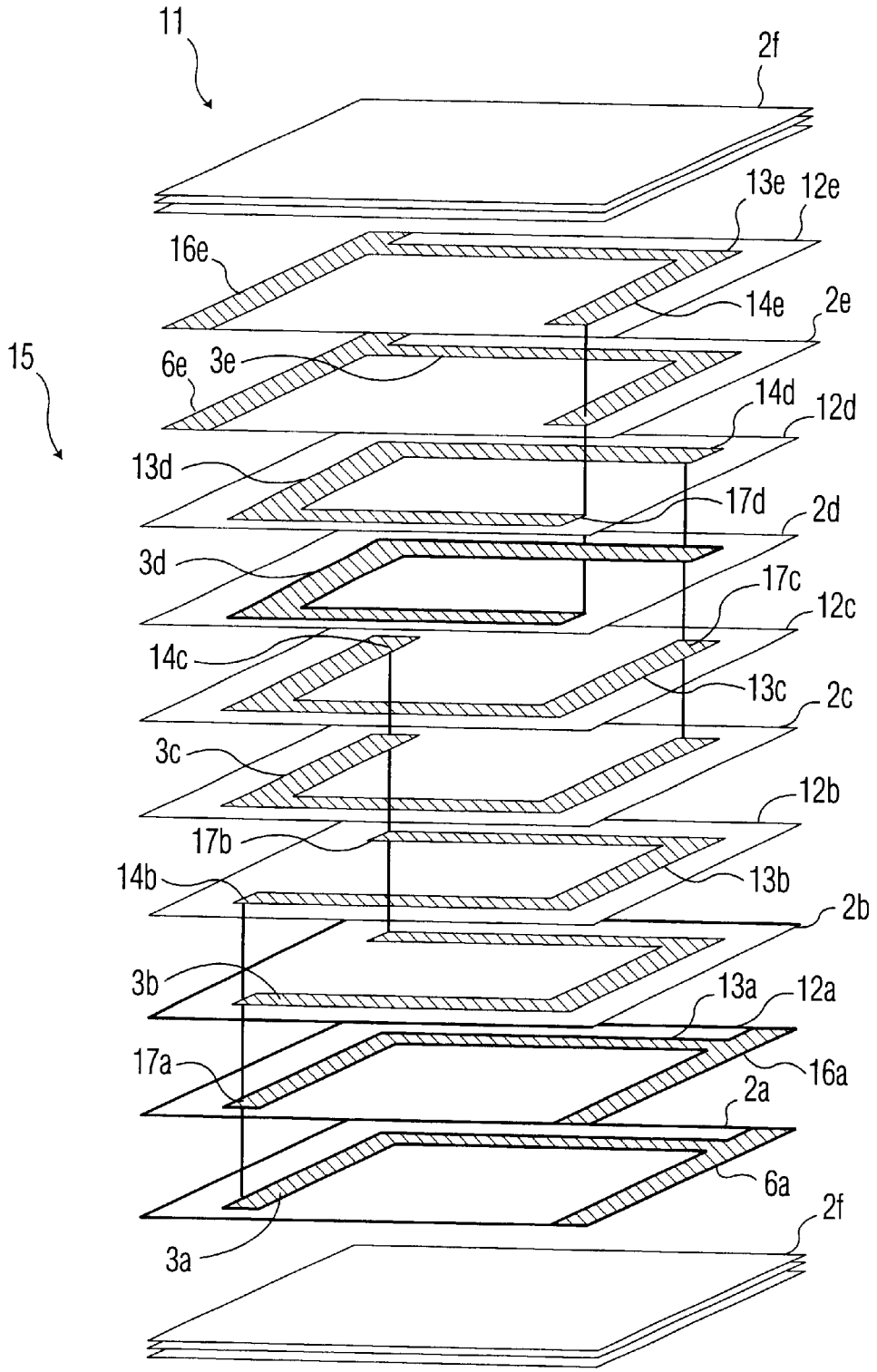
FIG. 6 (PRIOR ART)
FIG. 6 is a perspective view of a multilayer-type chip inductor of a second conventional example before multilayering.

Therefore, in the multilayer-type chip inductor 21, as shown in FIG. 3, an inductor 25, whose internal conductor is thicker than the thickness of the internal conductor of the multilayer-type chip inductors 1 and 11 shown in FIGS. 5 and 7, that is, having a larger cross-sectional area, is formed inside the multilayered body.

The multilayer-type chip inductor in accordance with the multilayer-type manufacturing method of the present invention is not limited to this embodiment, and various modifications are possible within the spirit and scope of the invention. For example, although an electrode film of a ¾ turn is shown, in addition to this, the electrode film may be of a ½ turn. Further, the shape of the electrode film is not limited to a coil shape, and may be a rectangular parallelepiped which connects the section between the two external electrodes by a straight line.

Further, the total number of windings of the inductor may be changed to any desired number of windings by increasing or decreasing the number of multilayers of the first and second green sheets.

As described above, in the method of manufacturing a multilayer-type chip inductor according to the present invention, since green sheets are multilayered so that surfaces on which electrode films are formed face each other in order to form an inductor, the thickness of the internal conductor is large, and the cross-sectional area increases accordingly.

Therefore, in the multilayer-type chip inductor according to the present invention, it is possible to reduce the DC resistance of the inductor without decreasing the inductance or the impedance. Further, the multilayer-type chip inductor according to the present invention becomes capable of withstanding a high-current load, and the allowable current value increases.

Many different embodiments of the present invention may be constructed without departing from the spirit and scope of the present invention. It should be understood that the present invention is not limited to the specific embodiment described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An inductor produced by a method comprising the steps of:

preparing a plurality of ceramic green sheets;

forming an electrode film on a surface of each of said plurality of green sheets; and assembling said plurality of green sheets such that a first pair of said green sheets are arranged such that the electrode films on their respective sheet surfaces face each other and are in electrical contact with each other, and such that a second pair of said green sheets are arranged such that the electrode films on their respective sheet surfaces face each other and are in electrical contact with each other, wherein the first and second pairs of green sheets face each other at another surface of the green sheets on which the electrode film is not formed such that the first and second pair of green sheets are electrically connected by via holes formed in the green sheets which face each other at the another surface on which electrode film is not formed.

2. The inductor of claim 1, wherein said first and second pairs of green sheets are arranged such the electrode films on their respective sheet surfaces are spatially aligned with each other when the sheets of said pair are placed together.

3. The inductor of claim 1, wherein said first and second pairs of green sheets each comprise a plurality of pairs of green sheets, each of said pairs of said green sheets being arranged such that the electrode films on their respective sheet surfaces face each other and are in electrical contact with each other.

4. The inductor of claim 3, wherein said plurality of pairs are electrically connected to each other.

5. The inductor of claim 4, wherein said plurality of pairs are connected to each other by at least one via hole.

6. The inductor of claim 3, wherein said electrode films on each of said green sheets comprises a conductive pattern forming a partial turn, such that, when said electrode films are connected together, at least one inductor is formed.

7. The inductor of claim 6, wherein the method of producing said inductor further comprises the step of forming external electrodes which conduct with ends of said inductor.

8. The inductor of claim 1, wherein at least one of said electrode films extends to an edge portion of its respective green sheet.

9. The inductor of claim 8, wherein the method of producing said inductor further comprises the step of forming at least one external electrode which connects with said at least one of said electrode films which extends to it respective edge portion.

10. The inductor of claim 1, wherein the method of producing said inductor further comprises a step of forming a plurality of dummy green sheets on the bottom of either of the first or second pairs of green sheets, each of said dummy green sheets having no electrode film on the surface thereof.

11. The inductor of claim 10, wherein the method of producing said inductor further comprises a step of forming a plurality of dummy green sheets on the top of either of the first or second pairs of green sheets, each of said dummy green sheets having no electrode film on the surface thereof.

12. The inductor of claim 1, wherein the method of producing said inductor further comprises the steps of, after said step of assembling:

contact-bonding the green sheets; and sintering the green sheets.

13. The inductor of claim 1, wherein said ceramic is an insulating ceramic.

14. An inductor produced by a method comprising the steps of:

preparing a ceramic green sheet;

overlaying a first green sheet having a coil-like electrode film of less than one complete turn formed on one surface thereof and a second green sheet having formed thereon another coil-like electrode film which is symmetrical with respect to said first green sheet so that said electrode films face each other in order to be formed into a first pair;

overlaying a third green sheet having an electrode film of less than one complete turn formed on one surface thereof and a fourth green sheet having formed thereon another electrode film which is symmetrical with respect to said third green sheet so that said electrode films face each other in order to be formed into a second pair;

multilayering a plurality of such pairs of said green sheets;

contact-bonding the green sheets; and sintering the green sheets, wherein the first and second pair of green sheets are selectively interconnected by via holes provided at ends of said electrode films, thereby forming an inductor, wherein the first and second pair of green sheets face each other at another surface of the green sheets on which the electrode film is not formed such that the first and second pair of green sheets are electrically connected by via holes formed in the green sheets which face each other at the another surface on which electrode film is not formed.

15. The inductor of claim 14, wherein said ceramic is an insulating ceramic.

16. The inductor of claim 14, wherein the method of producing said inductor further comprises the step of forming external electrodes which conduct to the ends of said inductor before or after being sintered.

* * * * *